US011195643B2

(12) United States Patent
Feichtinger et al.

(10) Patent No.: US 11,195,643 B2
(45) Date of Patent: Dec. 7, 2021

(54) MULTILAYER VARISTOR HAVING A FIELD-OPTIMIZED MICROSTRUCTURE

(71) Applicant: TDK Electronics AG, Munich (DE)

(72) Inventors: Thomas Feichtinger, Graz (AT); Michael Hofstätter, Graz (AT); Hermann Grünbichler, St. Josef (AT)

(73) Assignee: TDK ELECTRONICS AG, Munich (DE)

( * ) Notice: Subject to any disclaimer, the term of this patent is extended or adjusted under 35 U.S.C. 154(b) by 0 days.

(21) Appl. No.: 17/254,707

(22) PCT Filed: Jul. 2, 2019

(86) PCT No.: PCT/EP2019/067746
§ 371 (c)(1),
(2) Date: Dec. 21, 2020

(87) PCT Pub. No.: WO2020/007864
PCT Pub. Date: Jan. 9, 2020

(65) Prior Publication Data

US 2021/0217545 A1 Jul. 15, 2021

(30) Foreign Application Priority Data

Jul. 4, 2018 (DE) ..... 102018116221.9

(51) Int. Cl.
*H01C 7/10* (2006.01)
*H01C 1/16* (2006.01)

(52) U.S. Cl.
CPC ..... *H01C 7/10* (2013.01); *H01C 1/16* (2013.01)

(58) Field of Classification Search
CPC ..... H01C 7/10; H01C 1/16
USPC ..... 338/20
See application file for complete search history.

(56) References Cited

U.S. PATENT DOCUMENTS

| | | | | |
|---|---|---|---|---|
| 6,087,923 | A * | 7/2000 | Ahn | H01C 7/1006 338/21 |
| 6,184,770 | B1 | 2/2001 | Nakamura et al. | |
| 6,346,871 | B1 | 2/2002 | Ogasawara et al. | |
| 7,167,352 | B2 | 1/2007 | Matsuoka et al. | |
| 8,179,210 | B2 | 5/2012 | Feichtinger | |
| 10,204,722 | B2 | 2/2019 | Rinner et al. | |
| 2014/0171289 | A1 | 6/2014 | Itami et al. | |

(Continued)

FOREIGN PATENT DOCUMENTS

| | | | |
|---|---|---|---|
| DE | 69823637 | T2 | 9/2004 |
| DE | 102005026731 | A1 | 3/2006 |
| DE | 19915661 | B4 | 6/2008 |

(Continued)

*Primary Examiner* — Edwin A. Leon
*Assistant Examiner* — Iman Malakooti
(74) *Attorney, Agent, or Firm* — Slater Matsil, LLP

(57) ABSTRACT

In an embodiment a multilayer varistor includes a ceramic body made from a varistor material, wherein the ceramic body includes a plurality of inner electrodes, first regions and second regions, wherein the varistor material in the first regions has a first average grain size $D_A$, wherein the varistor material in the second regions has a second average grain size $D_B$, and wherein $D_A<D_B$.

14 Claims, 5 Drawing Sheets

(56) References Cited

U.S. PATENT DOCUMENTS

2015/0214202 A1* 7/2015 Woo ..... H01C 17/00
257/99

FOREIGN PATENT DOCUMENTS

| | | | | | |
|---|---|---|---|---|---|
| DE | 102007020783 | A1 | | 11/2008 | |
| DE | 102014107040 | A1 | | 11/2015 | |
| DE | 102017105673 | A1 | | 9/2018 | |
| JP | H11307312 | | * | 11/1999 | ..... H01C 7/10 |
| JP | H11307312 | A | | 11/1999 | |

* cited by examiner

MULTILAYER VARISTOR HAVING A FIELD-OPTIMIZED MICROSTRUCTURE

This patent application is a national phase filing under section 371 of PCT/EP2019/067746, filed Jul. 2, 2019, which claims the priority of German patent application 102018116221.9, filed Jul. 4, 2018, each of which is incorporated herein by reference in its entirety.

TECHNICAL FIELD

The invention relates to a multilayer varistor which comprises a ceramic body.

BACKGROUND

Multilayer varistors based on ZnO ceramics are widespread components for protecting against overvoltage. In the wake of ever-rising requirements in the sphere of the miniaturization and performance boosting of such components, it is necessary for the varistor properties to be continually improved. There is also a continual rise in the stability required of such components, so making it necessary to obtain improvements in, for example, the electrical insulation resistance, pulse resistance, and turn-on and clamping behavior of multilayer varistors.

In the case of a typical electro-thermomechanical overload scenario in the wake of a current surge, such as in the case of a lightning strike or an electrostatic discharge, for example, the current density is not distributed uniformly along the inner electrodes of the multilayer varistor, and this results in an uneven heating of these. This induces mechanical stress in the ceramic body of the multilayer varistor, possibly leading to cracks in said body and hence to the total failure of the multilayer varistor. To avoid this it would be necessary, for example, to optimize the distribution of the current density along the inner electrodes in such a way that there is no local overheating of the inner electrodes, which could cause the destruction of the ceramic body of the varistor.

Furthermore, in order to meet the increasing demands on the performance and miniaturization of varistors, it is necessary to continuously improve the varistor characteristics, especially the specific varistor voltage. Since the specific varistor voltage increases with the number of serially connected grain boundaries of ZnO grains between the contacts of the varistor, one way to increase the specific varistor voltage in a given volume is to reduce the size of the ZnO grains and thus increase the number of serially connected grain boundaries in a given Volume.

From German Patent No. 19915661 B4 a multilayer varistor is known which exhibits excellent varistor properties and comprises a ceramic body whose average grain size is in the range between 0.9 μm and 3.0 μm inclusive. Due to the grain structure of the ceramic body, it is not possible to locally avoid excessive current densities effectively, resulting in a varistor of reduced stability.

Furthermore, a varistor component is known from DE 10 2017 105 673 A1, which comprises a base body having a first region and a second region. The first region contains a first varistor material, and the second region contains a second varistor material, different from the first varistor material. It is possible for the first and second varistor materials to differ only in their grain size.

Moreover, from German Patent Application No. 10 2014 107 040 A1 a disc varistor is known, which comprises a functional body and a contact that is in electrically conducting connection to the functional body. The functional body has a first and a second functional body section, with a varistor material in the first functional body section having a smaller grain size than the varistor material in the second functional body section.

From German Patent Application No. 10 2007 020 783 A1 a module composed of a plurality of amalgamated multilayer varistors is known.

SUMMARY

Embodiments provide a multilayer varistor having an improved grain structure.

According to embodiments a multilayer varistor is provided, which has a plurality of regions, wherein first regions have a first average grain size $D_A$ and second regions have a second average grain size $D_B$, with $D_A$ being smaller than $D_B$. By forming such different regions in the ceramic body of the multilayer varistor, the microstructure of the ceramic body can be adapted ideally to the different field strengths within it. As a result, the current densities that occur are homogenized along the inner electrodes, and any uneven heating of these electrodes is prevented. This leads to less mechanical stress being induced in the ceramic body, and to an increase in the stability of the multilayer varistor.

The production of different first and second regions is carried out by targeted reduction of the average grain size in the first regions. Alternatively, the average grain size can be increased specifically in the second areas.

The multilayer varistor according to embodiments may further comprise a ceramic body made of varistor material, wherein the first and second regions are selected such that the specific varistor properties are improved. As a result, the threshold voltage of the multilayer varistor can be increased, or, for a given threshold voltage, the active zones of the ceramic body can be reduced. Moreover, for given volumes of the active zones and a given threshold voltage of the multilayer varistor according to embodiments, it is possible to increase the number of the inner electrodes and thereby to better divert the currents that occur, thus improving the current robustness of the multilayer varistor according to embodiments.

Zones referred to as active zones here and hereinafter are the regions between the different inner electrodes of different polarity, which are critical to the flow of current between said electrodes. In contrast, the regions in the ceramic body of the multilayer varistor that do not contribute to the current flow between the differently contacted inner electrodes are referred to hereinafter as inactive zones.

Furthermore, the multilayer varistor according to embodiments may comprise a ceramic body, with the first and second regions being selected such that the average grain size in the inactive zones is smaller than in the active zones, so increasing the insulation resistance of the inactive zones of the ceramic body and thereby making it possible to reduce the size of the inactive zones. This enables further miniaturization of the multilayer varistor.

In one embodiment of the multilayer varistor, the second regions can have an average grain size of >3 μm and the first regions an average grain size of <3 μm. Although an improvement in the varistor properties occurs even with small differences between the average grain sizes of the first and second regions, this effect can be enhanced with increasing difference between the average grain sizes of the first and second regions.

In another embodiment of the multilayer varistor, the second regions can have an average grain size of >0.9 μm and the first regions an average grain size of <0.9 μm. As a result of this small grain size, higher threshold voltages can be achieved for a given volume of the active zone. Furthermore, for a given threshold voltage, the volume of the active zone can be reduced, so achieving further miniaturization of the multilayer varistor. Moreover, with a given threshold voltage and given active volume, it is possible to increase the number of inner electrodes in the active zone, so enabling more effective diversion of electrical currents that occur. As a result, the current robustness of the multilayer varistor is improved.

In a further embodiment, the first and second regions with different average grain sizes may each comprise, independently of one another, a layer or an areal region of a partial layer of the multilayer varistor according to embodiments, there being at least one second region and one first region.

In at least one further embodiment, the multilayer varistor comprises a ceramic body in which first and second differently contacted inner electrodes overlap. Here it is possible for the active zones between the first and second differently contacted, overlapping inner electrodes to comprise the first regions, and for the inactive zones of the ceramic body to comprise the second regions. Consequently, for a given active volume, the threshold voltage of the multilayer varistor according to embodiments can be increased, or, for a given threshold voltage, the volume of the active zones of the ceramic body can be decreased, thereby enabling further miniaturization of the multilayer varistor to be achieved. In addition, at given volumes of the active zones and a given threshold voltage, a greater number of inner electrodes can be introduced into the active zones, which are thus enabled better to divert the electrical currents that occur, hence enabling an increase in the current robustness of the multilayer varistor according to embodiments.

In a further embodiment, the multilayer varistor comprises a ceramic body in which the active zones around the regions of the ends of the first and second inner electrodes can comprise the first regions, and the remaining active zones and the inactive zones comprise the second regions. This allows preventing a local exceedance of the current density in the zones, thus a reduced local heating of the inner electrodes and hence of a reduction in the mechanical load on the ceramic body can be achieved.

In a further embodiment, the ceramic body of the multilayer varistor may comprise a plurality of serially connected varistors, wherein the active zones around the regions of the ends of the differently contacted first and second inner electrodes comprise first regions. Furthermore, the regions around the ends of connecting inner electrodes, which interconnect the multilayer varistors with the differently contacted first and second inner electrodes, may also comprise first regions. The rest of the active zones and the inactive zones may then comprise the second regions.

In at least one further embodiment, the multilayer varistor comprises a ceramic body wherein the first and second differently contacted inner electrodes can face each other frontally in a layer plane, and the active zone between the differently contacted inner electrodes comprises the first regions, and the inactive zones comprise the second regions. This allows the field strength at the tips of the inner electrodes to be optimized, hence enabling an improvement in the stability of the multilayer varistor according to embodiments. This also makes it possible to increase the threshold voltage of the multilayer varistor.

In a further embodiment, the multilayer varistor comprises a ceramic body wherein the inactive zones may comprise the first regions, and the active zones may comprise the second regions. Through the smaller average grain size in the inactive zones, the number of grains per unit volume can be increased, so enabling an increase in the specific varistor voltage in these zones. This makes it possible to raise the necessary voltage, which for an unwanted voltage breakdown of, for example, the inner electrodes to the outer regions of the multilayer varistor according to embodiments, so making it possible to improve the electrical insulation resistance of the multilayer varistor. Moreover, for a given insulation resistance, it is possible to reduce the volume of the inactive zones, thereby permitting a smaller construction for the multilayer varistor according to embodiments.

In a further embodiment, a module is specified that comprises a ceramic body, in which a plurality of multilayer varistors according to embodiments are combined and arranged at a defined distance from one another. Furthermore, a volume region comprising inner electrodes, and comprising the inner electrodes of the various varistors in the module, may comprise the first regions, and the volume regions which do not contain any inner electrodes may comprise the second regions. Owing to the increased specific varistor voltage achieved by the smaller average grain size, it is possible to raise the insulation resistance between the inner electrodes of the varistors arranged at a defined distance from one another. By this it is possible to prevent a voltage breakdown between the inner electrodes of the varistors arranged at a defined distance from one another.

In a further embodiment, the multilayer varistor comprises a ceramic body in which a plurality of varistors is combined to form a module. On the module there may also be contacts for further components, such as exterior leads, power semiconductors or cooling elements, for example. To improve the insulation resistance between the inner electrodes and the other components, volume regions containing inner electrodes and volume regions which border on the contacts for the further components may comprise the first regions, and volume regions which contain no inner electrodes and volume regions which do not border on the contacts for further components may comprise the second regions.

BRIEF DESCRIPTION OF THE DRAWINGS

The invention is described in more detail hereinafter with reference to exemplary embodiments and associated figures.

Identical elements, similar elements or apparently similar elements in the figures have been given the same reference symbols. The figures and the size ratios in the figures are not to scale. The regions in FIGS. 1 to 7 shown with shading are regions with relatively small average grain size, while unshaded regions are regions with relatively greater average grain size.

DETAILED DESCRIPTION OF ILLUSTRATIVE EMBODIMENTS

Figure 1:
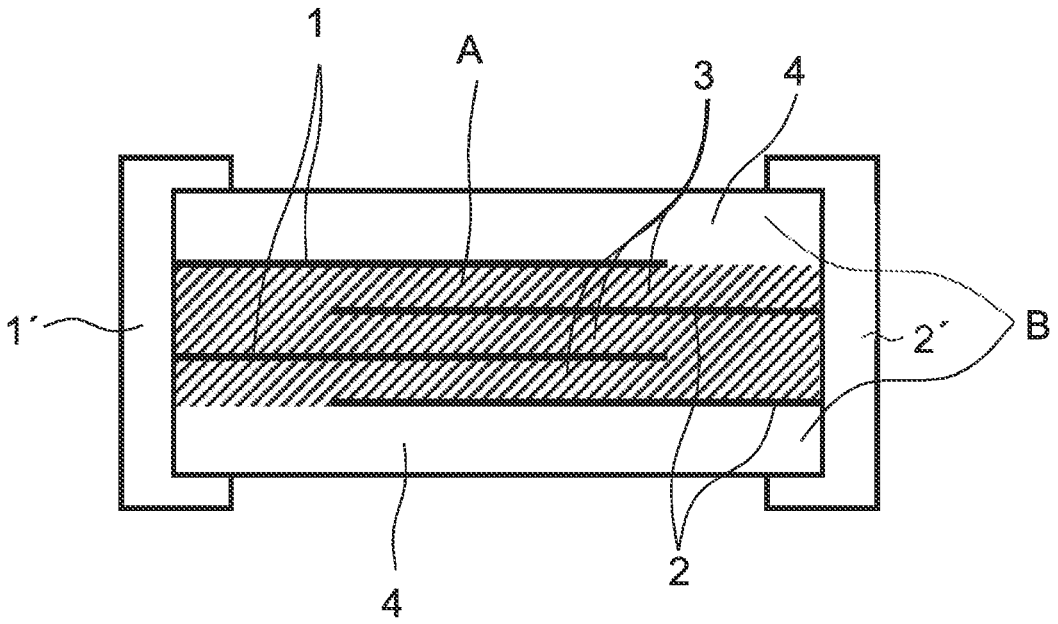
FIG. 1 shows in a schematic cross section an embodiment of a multilayer varistor having a reduced average grain size in the active zones.

FIG. 1 shows in a schematic cross section an embodiment of a multilayer varistor which comprises a ceramic body, with active zones 3 between first and second, differently contacted inner electrodes 1 and 2 comprising first regions A, and inactive zones 4 comprising second regions B. The first regions A here have an average grain size of <3 μm, and the second regions B have an average grain size of >3 μm. As a result of the reduced average grain size in the active zones it becomes possible to achieve higher threshold voltages for given volumes of the active zones. Moreover, it becomes possible to reduce the volume of the active zone for a given threshold voltage, so achieving further miniaturization of the multilayer varistor. It becomes possible, furthermore, for a given threshold voltage and given active volume, to increase the number of inner electrodes in the active volume, with consequently better diversion of occurring electrical currents. As a result, the current robustness of the multilayer varistor is improved.

Figure 2:
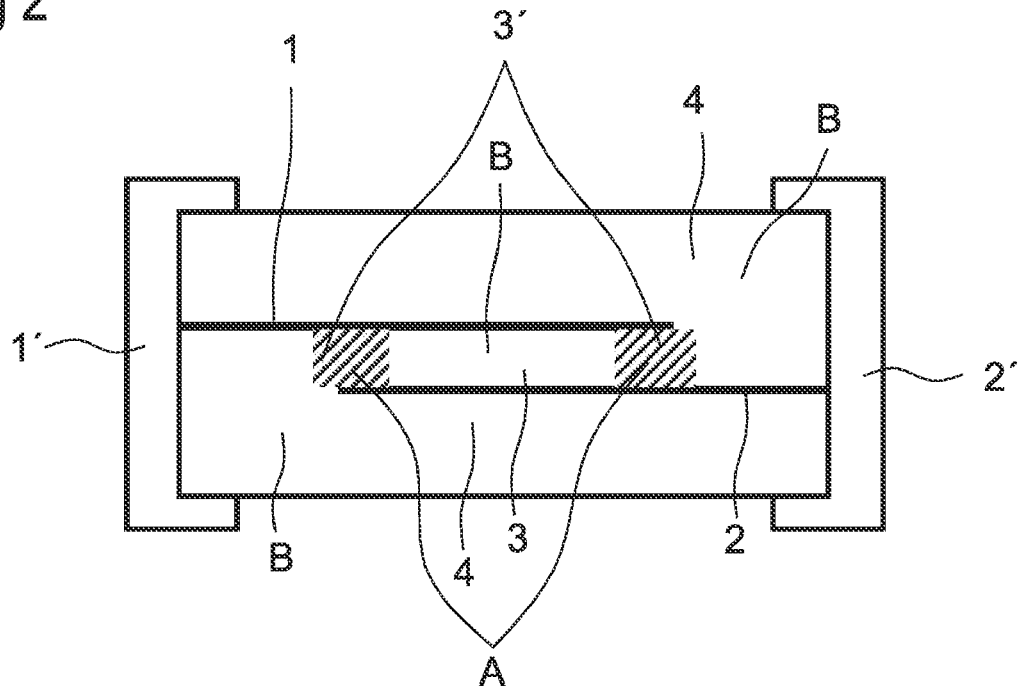
FIG. 2 shows in a schematic cross section an embodiment of a multilayer varistor having a reduced average grain size in the active zones in the region around the ends of the inner electrodes.

FIG. 2 shows in a schematic cross section an embodiment of a multilayer varistor which comprises a ceramic body, where active zones 3' around the regions of the ends of the differently contacted first and second inner electrodes 1 and 2 comprise the first regions A, and the rest of the active zones 3, and the inactive zones 4, comprise the second regions B. The first regions A here have an average grain size of <3 μm, and the second regions (B) have an average grain size of >3 μm. As a result of the reduced grain size in the active zones 3' around the regions of the ends of the differently contacted first and second inner electrodes 1 and 2, the current density is evened out along these electrodes and local heating thereof is prevented. As a result, consequently, of a reduced mechanical load on the ceramic body, the stability of the multilayer varistor is improved.

Figure 3:
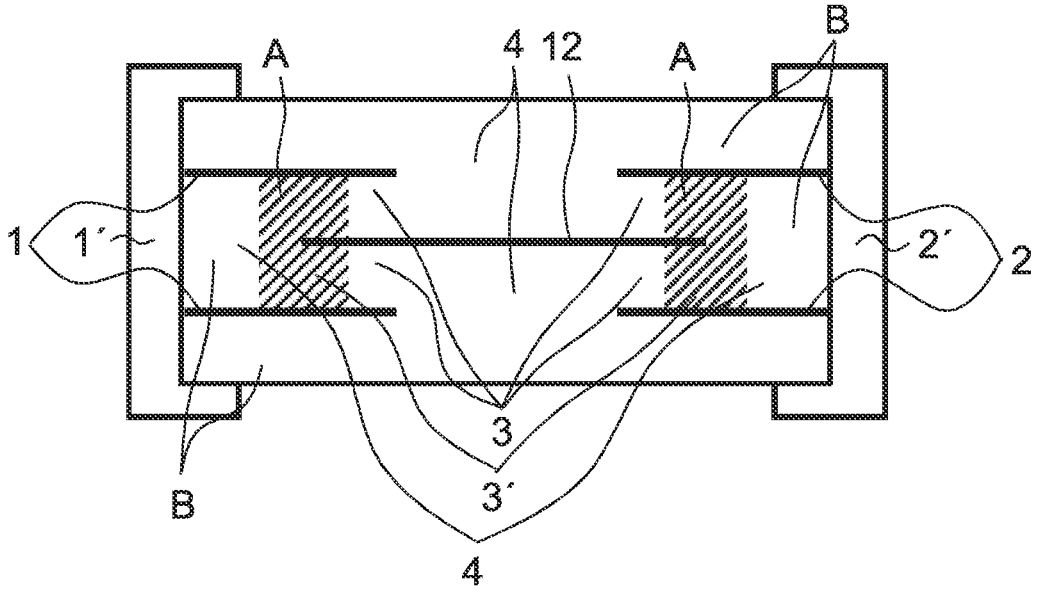
FIG. 3 shows in a schematic cross section an embodiment of a multilayer varistor having serially connected varistors and a reduced average grain size in the active zones in the region around the ends of the inner electrodes.

FIG. 3 shows in a schematic cross section an embodiment of a multilayer varistor which comprises a ceramic body, comprising two serially connected varistors, where the active zones 3' around the regions of the ends of the connecting inner electrode 12 comprise the first regions A, and the rest of the active zones 3, and the inactive zones 4, comprise the second regions B. The first regions A here have an average grain size of <3 μm, and the second regions B have an average grain size of >3 μm. As a result of the reduced grain size in the active zones 3' around the regions of the ends of the connecting inner electrode 12, the current density in these zones is reduced and local heating of the inner electrodes is prevented. Since this results in a reduced mechanical load on the ceramic body, the stability of the multilayer varistor is improved.

Figure 4:
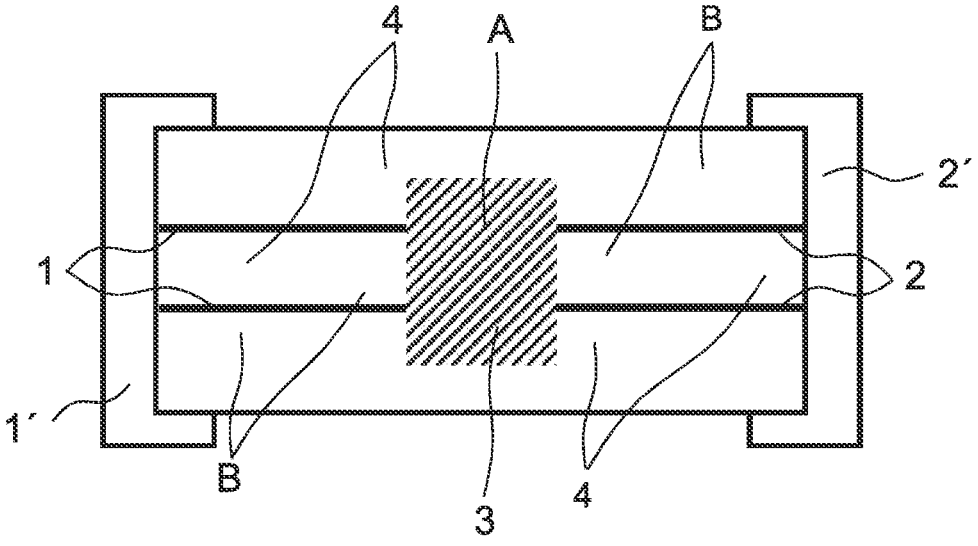
FIG. 4 shows in a schematic cross section an embodiment of a multilayer varistor having oppositely contacted, mutually confronting ends of the inner electrodes and a reduced average grain size in the active zone between the oppositely contacted inner electrodes.

FIG. 4 shows in a schematic cross section an embodiment of a multilayer varistor comprising a ceramic body in which the differently contacted first and second inner electrodes 1 and 2 in a layer plane face each other frontally, wherein the active zone 3 between the differently contacted first and second inner electrodes 1 and 2 comprises the first regions A, and the inactive zones 4 comprises the second regions B. Here, the first regions A have an average grain size of <3 μm, and the second regions B have an average grain size of >3 μm. As a result of the reduced grain size in the active zone 3, the threshold voltage of the multilayer varistor is increased, and current density at the ends of the differently contacted first and second inner electrodes 1 and 2 is optimized, thereby improving the stability and the varistor properties of the multilayer varistor.

Figure 5:
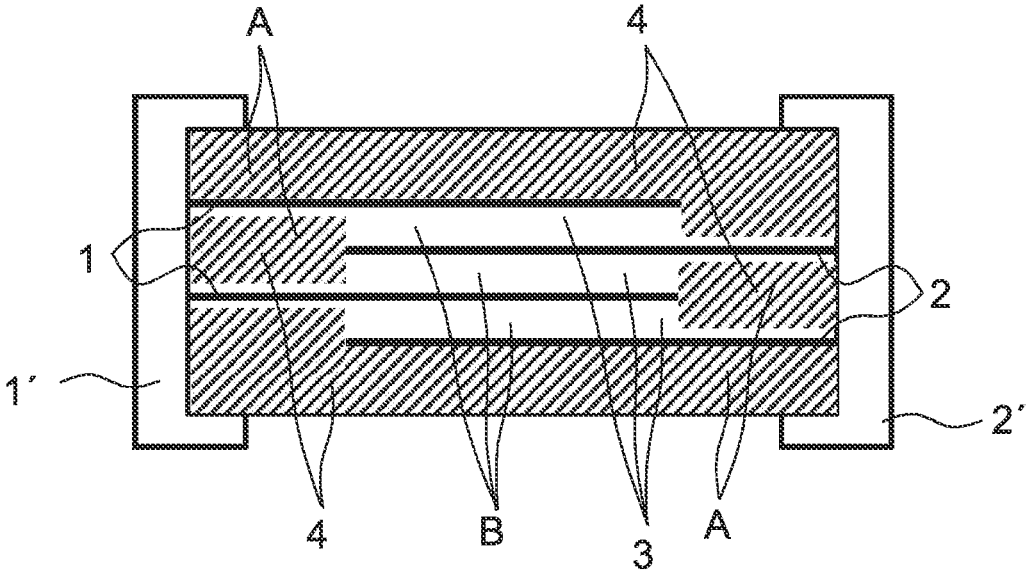
FIG. 5 shows in a schematic cross section an embodiment of a multilayer varistor having a reduced average grain size in the inactive zones.

FIG. 5 shows in a schematic cross section an embodiment of a multilayer varistor which comprises a ceramic body, where the active zones 3 between the differently contacted first and second inner electrodes 1 and 2 comprise the second regions B, and the inactive zones 4 comprise the first regions A. Here, the first regions A have an average grain size of <3 μm, and the second regions B have an average grain size of >3 μm. As a result of the reduced average grain size in the inactive zones 4, the electrical insulation resistance of these zones is increased.

Figure 6:
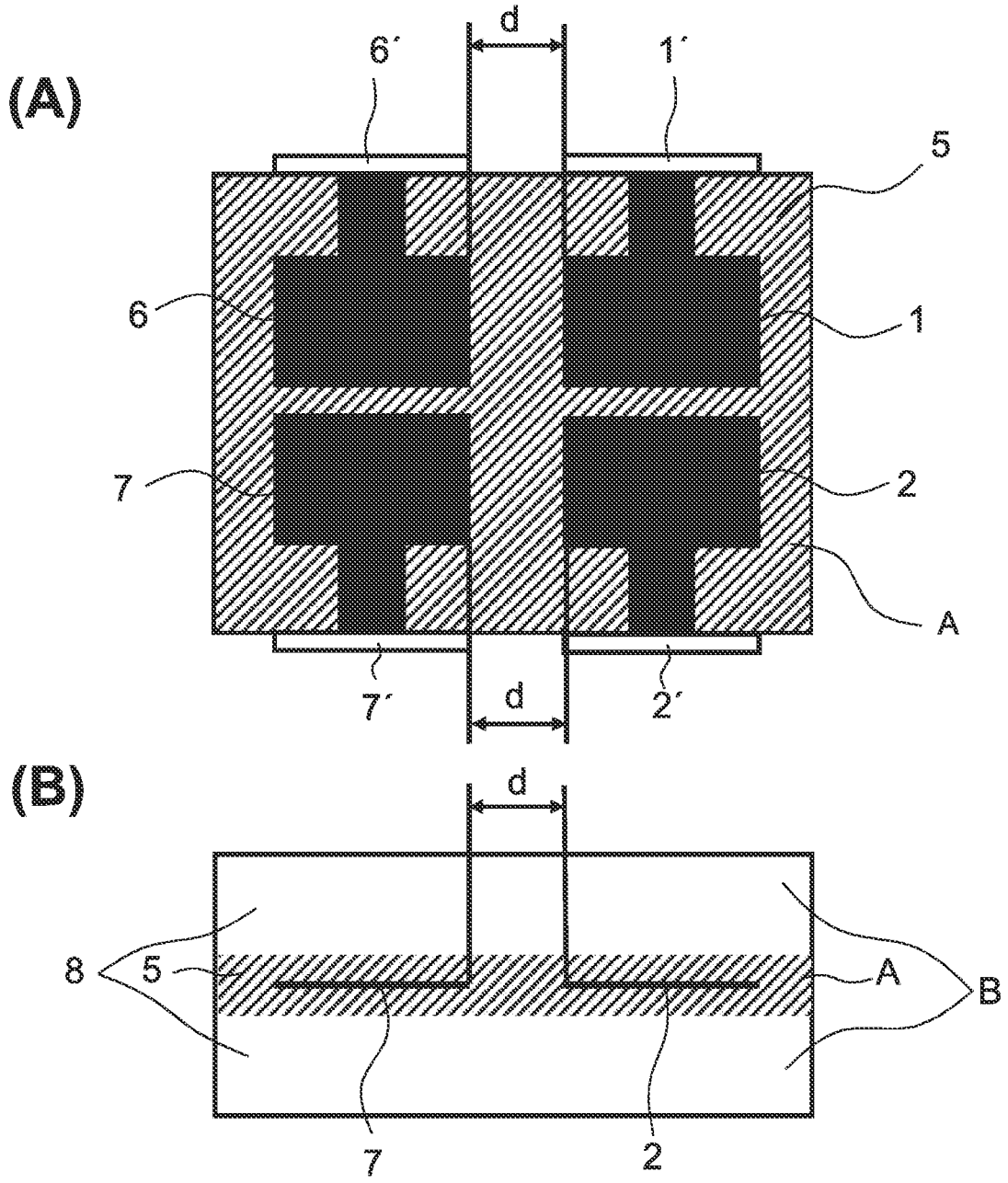
FIG. 6 shows in a schematic cross section and a plan view an embodiment of a multilayer varistor module having a reduced average grain size in the volume region containing inner electrodes.

FIG. 6 shows in a plane view A and a schematic cross section B an embodiment of a multilayer varistor module which comprises a ceramic body, in which a first and a second varistor according to embodiments are combined and arranged at a defined distance d from one another. Here, the first varistor according embodiments comprises the differently contacted first and second inner electrodes 1 and 2, and the second varistor according to embodiments comprises the differently contacted third and fourth inner electrodes 6 and 7. A volume region 5 containing inner electrodes comprising the inner electrodes 1, 2, 6 and 7 comprises the first regions A, and the volume regions 8 which do not contain any inner electrodes comprise the second regions B. Here, the first regions A have an average grain size of <3 μm, and the second regions B have an average grain size of >3 μm. As a result of the reduced average grain size, especially in the regions of the distance d between inner electrodes of the first and second varistors, the insulation resistance in these regions is increased. As a result, a mutual negative influence of the first and second varistors on each other as a result of unwanted voltage breakdowns over the distance d is prevented.

Figure 7:
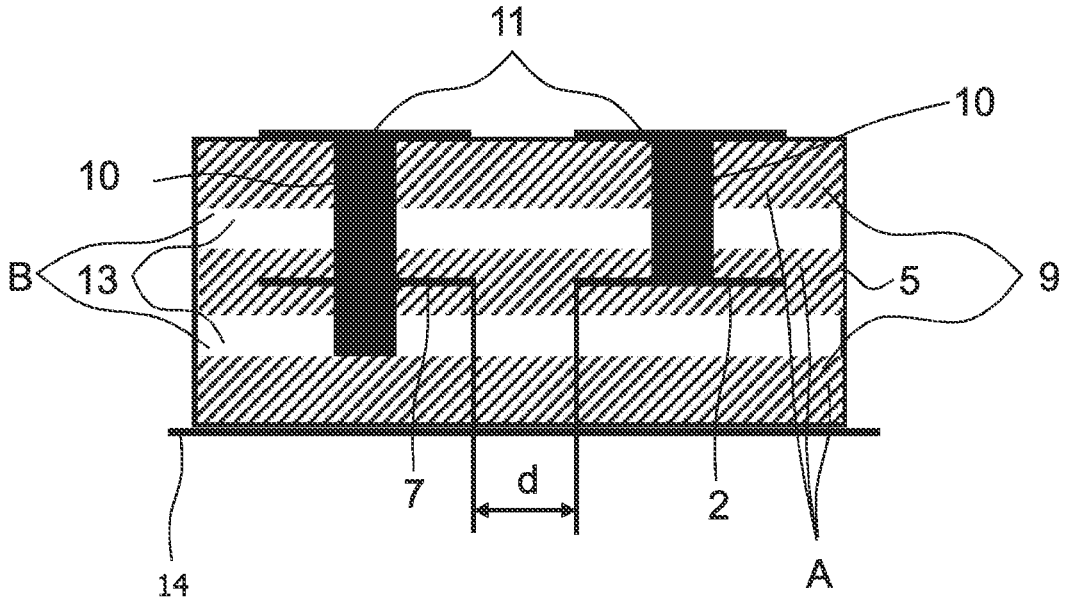
FIG. 7 shows in a schematic cross section an embodiment of a multilayer varistor module having contacts for further components and having a reduced average grain size in the volume regions containing inner electrodes and in the volume regions bordering on the external contacts.

FIG. 7 shows in a schematic cross section A an embodiment of a multilayer varistor module which comprises a ceramic body, which combines the first and the second varistors according to embodiments, arranged at a defined distance d from one another. Moreover, the ceramic body of the multilayer varistor module comprises internal contacts 10 and external contacts 11 and 14, by which further components (not shown) can be mounted on the module. In addition, the volume region 5 containing inner electrodes, and the volume regions 9 which border on the external contacts 11 and 14, contain the first regions A with an average grain size of <3 μm. The volume regions 13 which contain no inner electrodes and do not border on the contacts 11 and 14 contain the second regions B with an average grain size of >3 μm. As a result of the average grain size in the volume regions 5 and 9, reduced relative to the volume regions 13, there is first an increase in the insulation resistance at the distance d between, for example, the second inner electrode 2 of the first varistor and the fourth inner electrode 7 of the second varistor, but also the insulation resistance between the second inner electrode 2 of the first varistor and the fourth inner electrode 7 of the second varistor and the external contacts 11 and 14 is improved. This prevents negative interaction between the varistors and, for example, a power semiconductor, such as an LED.

The invention is not restricted to the exemplary embodiments by the description on the basis of said exemplary embodiments. Rather, the invention encompasses any new feature and also any combination of features, which in particular comprises any combination of features in the patent claims and any combination of features in the exemplary embodiments, even if this feature or this combination itself is not explicitly specified in the patent claims or exemplary embodiments.

The invention claimed is:

1. A multilayer varistor comprising:

a ceramic body made from a varistor material, wherein the ceramic body comprises a plurality of inner electrodes, first regions and second regions, wherein the first regions are arranged in active zones of the varistor, and the second regions are arranged in inactive zones of the varistor, wherein the varistor material in the first regions has a first average grain size $D_A$, wherein the varistor material in the second regions has a second average grain size $D_B$, and wherein $D_A<D_B$.

2. The multilayer varistor according to claim 1, wherein the first regions have an average grain size $D_A<3$ μm and the second regions have an average grain size $D_B>3$ μm.

3. The multilayer varistor according to claim 1, wherein the first regions have an average grain size $D_A<0.9$ μm and the second regions have an average grain size $D_B>0.9$ μm.

4. The multilayer varistor according to claim 1, wherein each region comprises at least one partial layer or an areal region of a partial layer of the ceramic body.

5. The multilayer varistor according to claim 1, wherein the active zones are formed in the regions around ends of differently contacted first and second inner electrodes, and wherein the second regions are formed in the further active zones and the inactive zones.

6. The multilayer varistor according to claim 5, wherein a plurality of varistors in the ceramic body are in serial interconnection with one another.

7. The multilayer varistor according to claim 1, wherein ends of the differently contacted first and second inner electrodes of the multilayer varistor each frontally face each another, and wherein the first regions are formed in the active zone between the differently contacted first and second inner electrodes, and the second regions are formed in the inactive zones.

8. A module comprising:

a plurality of combined multilayer varistors according to claim 1, wherein a volume region containing inner electrodes comprises the first regions and volume regions containing no inner electrodes comprise the second regions.

9. A module comprising:

a plurality of combined multilayer varistors according to claim 1, wherein the ceramic body has internal contacts and external contacts configured to be connected to further components, wherein a volume region contains inner electrodes and volume regions bordering the external contacts comprises the first regions, and wherein volume regions containing no inner electrodes and do not border the external contacts comprise the second regions.

10. The module according to claim 9, wherein the first regions have an average grain size $D_A<3$ μm and the second regions have an average grain size $D_B>3$ μm.

11. The module according to claim 9, wherein the first regions have an average grain size $D_A<0.9$ μm and the second regions have an average grain size $D_B>0.9$ μm.

12. A module comprising:

a plurality of combined multilayer varistors comprising a ceramic main body made from a varistor material, wherein the ceramic body comprises a plurality of inner electrodes, first regions and second regions, wherein the varistor material in the first regions has a first average grain size $D_A$, wherein the varistor material in the second regions has a second average grain size $D_B$, wherein $D_A<D_B$, wherein the ceramic body has internal contacts and external contacts configured to be connected to further components, wherein a volume region contains inner electrodes and volume regions bordering the external contacts comprises the first regions, and wherein volume regions containing no inner electrodes and do not border the external contacts comprise the second regions.

13. The module according to claim 12, wherein the first regions have an average grain size $D_A<3$ μm and the second regions have an average grain size $D_B>3$ μm.

14. The module according to claim 12, wherein the first regions have an average grain size $D_A<0.9$ μm and the second regions have an average grain size $D_B>0.9$ μm.

* * * * *